United States Patent [19]

Kasai

[11] Patent Number: 4,903,378

[45] Date of Patent: Feb. 27, 1990

[54] STRAP ADJUSTMENT ASSEMBLY

[75] Inventor: Kazumi Kasai, Namerikawa, Japan

[73] Assignee: Nippon Notion Kogyo Co., Ltd., Tokyo, Japan

[21] Appl. No.: 726,165

[22] Filed: Apr. 22, 1985

Related U.S. Application Data

[63] Continuation of Ser. No. 515,036, Jul. 18, 1983, abandoned.

[30] Foreign Application Priority Data

Aug. 12, 1982 [JP] Japan ..... 57-122729[U]

[51] Int. Cl.[4] ..... A44B 11/10

[52] U.S. Cl. ..... 24/196; 24/171

[58] Field of Search ..... 24/163 R, 171, 181, 24/616, 194–197; 262/242

[56] References Cited

U.S. PATENT DOCUMENTS

| | | | |
|---|---|---|---|
| 1,374,691 | 4/1921 | Troop | 24/196 |
| 1,873,371 | 8/1932 | Ford | 24/196 |
| 1,905,939 | 4/1933 | Joyce | 24/196 X |
| 2,743,497 | 5/1956 | Davis | 24/196 |
| 3,365,756 | 1/1968 | Bayon | 24/196 X |
| 3,414,947 | 12/1968 | Holmberg et al. | 24/196 |
| 3,443,005 | 5/1969 | Braun | 262/242 |
| 4,131,976 | 1/1979 | Bengtsson | 24/196 |
| 4,136,422 | 1/1979 | Ivanov et al. | 24/171 X |
| 4,150,464 | 4/1979 | Tracy | 24/196 X |
| 4,386,452 | 6/1983 | Stephenson | 24/171 X |
| 4,389,756 | 6/1983 | Kasama | 24/196 X |

FOREIGN PATENT DOCUMENTS

| | | | |
|---|---|---|---|
| 53-7934 | 3/1978 | Japan | 262/242 |
| 54-14424 | 11/1979 | Japan . | |

*Primary Examiner*—James R. Brittain

*Attorney, Agent, or Firm*—Hill, Van Santen, Steadman & Simpson

[57] ABSTRACT

A strap adjustment assembly generally comprises an open or hollow connector frame integrally molded of synthetic resin and a strap retainer integrally molded of synthetic resin and assembled in the hollow connector frame. The hollow connector frame includes a grip base having a strap bearing surface, a pair of spaced legs extending from the grip base and having a pair of oblong slots, respectively, and a connecting bar joining the legs remotely from the grip base by a distance. The strap retainer includes a central strap engagement portion, and a pair of arms extending from the central strap engagement portion and being non-rotatably loosely fitted in the slots, respectively. The central strap engagement portion has a strap pressing surface for frictionally pressing a strap end portion against the strap bearing surface. The strap pressing surface is transversely spaced from the arms at least by said distance. The connector frame and the strap retainer are simultaneously molded in an assembled condition.

3 Claims, 4 Drawing Sheets

FIG. 5
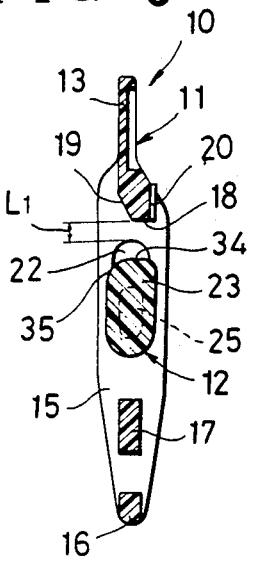
FIG. 6
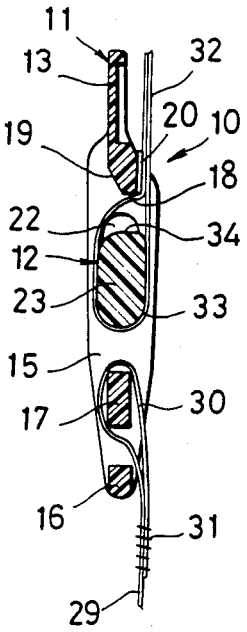
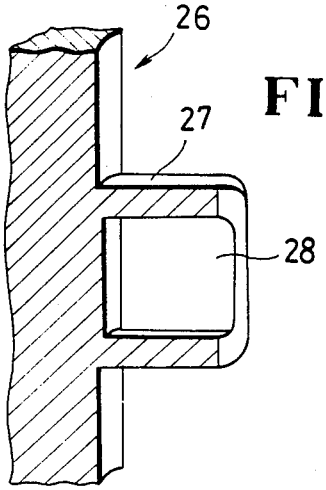
FIG. 7

STRAP ADJUSTMENT ASSEMBLY

This is a continuation of application Ser. No. 515,036, filed 7-18-83, now abandoned.

BACKGROUND OF THE INVENTION

1. Field of the Invention:

The present invention relates to a strap adjustment assembly of synthetic resin for adjustably interconnecting strap or belt ends on a bag or the like.

2. Description of the Prior Art:

Various strap adjustment assemblies have been devised and used for adjustably joining belt or strap ends on a bag or the like. Such strap adjustment assemblies principally comprise a hollow connector frame of a rectangular shape attached to a strap end and a strap retainer fixed to or movably mounted on the hollow connector frame for frictionally retaining another strap end.

With the strap retainer fixedly mounted on the hollow connector frame, the force with which the strap frictionally engages the strap retainer is relatively weak. Such a strap adjustment assembly cannot be used on heavy bags.

The strap adjustment assembly with the movable strap retainer is costly to construct because of the manufacturing step needed for mounting the strap retainer movably on the connector frame. The movable strap retainer imposes a relatively small frictional resistance to a thin strap. The strap adjustment assemblies made of synthetic resin are weak in mechanical strength particularly at junctions between a base and a pair of legs of the hollow connector frame.

SUMMARY OF THE INVENTION

It is an object of the present invention to provide a strap adjustment assembly made of synthetic resin which is simple in construction and large in mechanical strength.

Another object of the present invention is to provide a strap adjustment assembly having a movable strap retainer capable of imposing a relatively large frictional resistance to a strap regardless of the thickness thereof.

According to the present invention, a strap adjustment assembly includes a hollow or centrally open connector frame integrally molded of synthetic resin and composed of a base, a pair of legs extending transversely from the base, a strap connector extending between the legs, and a connecting portion joining the legs remotely from the base, and a strap retainer integrally molded of synthetic resin and having a central strap engagement portion and a pair of coaxial arms extending from opposite ends of the central strap engagement portion and loosely fitted respectively in a pair of slots defined in the legs of the hollow connector frame. The base has a strap bearing surface and a plurality of biting ridges extending therefrom parallel to the legs, and the central strap engagement portion has a strap pressing surface extending parallel to the strap bearing surface. The central strap engagement portion has a roughened surface similar to a grain finish to provide a large coefficient of friction. In use, a strap end portion is looped around the strap connector, and another strap end portion is looped around the strap retainer. When the strap is tensioned longitudinally, the strap retainer is displaced toward the base to cause the strap pressing surface to press the strap end portion on the strap retainer against the strap bearing surface. The strap end portion thus pressed is also engaged by the biting ridges. According to another embodiment, the strap connector is dispensed with, and a male member insertable in a female member is integrally formed with the connecting bar.

Many other advantages, features and additional objects of the present invention will become manifest to those versed in the art upon making reference to the detailed description and the accompanying sheets of drawings in which preferred structural embodiments incorporating the principles of the present invention are shown by way of illustrative example.

BRIEF DESCRIPTION OF THE DRAWINGS

FIG. 5 is a cross-sectional view taken along line V—V of FIG. 1;

FIG. 6 is a cross-sectional view showing the manner in which the strap adjustment assembly is used;

FIG. 7 is a fragmentary perspective view, partly in cross section, of a mold for molding a portion of the strap adjustment assembly illustrated in FIG. 1;

DETAILED DESCRIPTION

Figure 1:
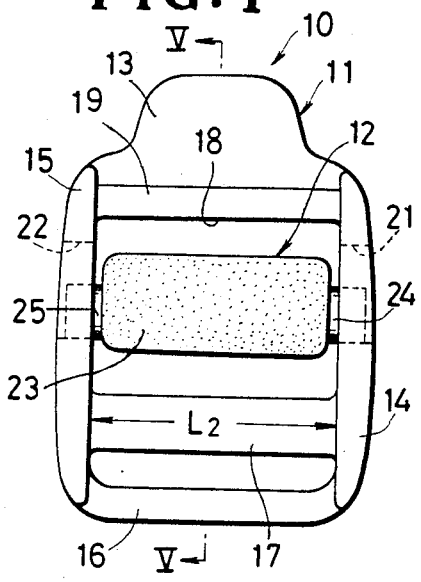
FIG. 1 is a plan view of a strap adjustment assembly according to the present invention.

FIGS. 1 through 6 show a strap adjustment assembly, generally indicated by the reference numeral 10, according to the present invention.

The strap adjustment assembly 10 comprises a connector frame 11 of an open or hollow rectangular shape or a substantially square shape and a strap retainer 12 movably mounted on the hollow connector frame 11. The hollow connector frame 11 and the strap retainer 12 are molded of synthetic resin.

The hollow connector frame 11 comprises an integral molded construction composed of a grip base 13, a pair of spaced parallel legs 14, 15 extending from opposite ends of the grip base 13, a connecting bar 16 joining the ends of the legs 14, 15 which are remote from the grip base 13, and a strap connector 17 extending between the legs 14, 15 and positioned more closely to the connecting bar 16 than to the grip base 13. The grip base 13 has a flat strap bearing surface 18 facing toward the strap connector 17 in parallel relation thereto and a slanted surface 19 contiguous to the flat strap bearing surface 18 and blending into a face of the grip base 13. The grip base 13 also has on its back a plurality of parallel biting ridges 20 extending from the strap bearing surface 18 parallel to the legs 14, 15 away from the strap connector 17. Each of the biting ridges 20 has an end surface lying substantially flush with the strap bearing surface 18.

The legs 14, 15 have a pair of oblong slots 21, 22, respectively extending transversely therethrough in transverse registry with each other. As shown in FIG. 5, each slot 21, 22 has a longitudinal end spaced from the strap bearing surface 18 by a distance L1. Accordingly, the legs 14, 15 have substantial solid portions through which they are joined to the grip base 13. Each of the legs 14, 15 has a width greater than the widths of the grip base 13, the connecting bar 16, and the strap connector 17, as illustrated in FIG. 5.

Figure 2:
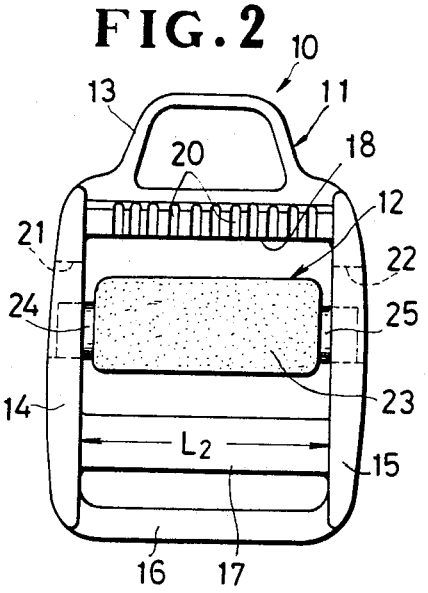
FIG. 2 is a bottom view of FIG. 1.
Figure 3:
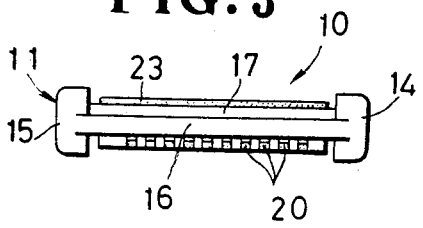
FIG. 3 is an end elevational view of the strap adjustment assembly of FIG. 1.
Figure 4:
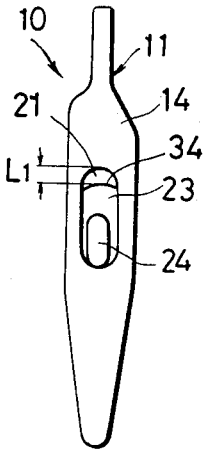
FIG. 4 is a side elevational view of FIG. 1.

As shown in FIGS. 1 and 2, the strap retainer 12 is composed of an elongate central strap-engagement portion 23 and a pair of aligned arms 24, 25 extending integrally from opposite ends of the central strap engagement portion 23, the arms 24, 25 having an elliptical cross section such that they are loosely received in the respective oblong slots 21, 22 and are slidably movable therein, but are prevented from rotating in the respective slots 21, 22. As illustrated in FIGS. 5 and 6, the central strap engagement portion 23 includes a flat strap pressing surface 34 extending in confronting relation to the strap bearing surface 18 and an arcuately curved surface 35 extending from the flat strap pressing surface 34 and blending into a face of the central strap engagement portion 23. In the illustrated embodiment, the central strap engagement portion 23 has a roughened surface similar to a grain finish, having a multiplicity of minute projections to give an increased coefficient of friction to the central strap engagement portion 23. The central strap engagement portion 23 is thicker than the arms 24, 25, with the flat strap pressing surface 34 spaced transversely from the arms 24, 25 at least by the distance L1 (FIG. 5). The arms 24, 25 are slightly displaced out of coaxial alignment with the central strap engagement portion 23 toward the strap connector 17.

The arms 24, 25 are molded loosely in the slots 21, 22 in the legs 14, 15 using a pair of molds, respectively, at the same time that the hollow connector frame 11 and the strap retainer 12 are molded. One of such molds is shown in FIG. 7, the mold being designated generally at 26. The mold 26 comprises a sleeve portion 27 having a recess 28. In molding operation, each slot 21, 22 is formed by an outer peripheral surface of the sleeve portion 27 while each arm 24, 25 is formed by an inner peripheral surface of the recess 28. These molds constitute part of an entire mold assembly for molding the hollow connector frame 11 and the strap retainer 12 at the same time.

In use, a strap end portion 29 is threaded between the connecting bar 16 and the strap connector 17 from the back to the face of the connector frame 11, and then between the strap connector 17 and the strap retainer 12 from the face to the back of the connector frame 11. The strap end portion 29 is turned over to form a loop 30 around the strap retainer 12 and sewn to itself with stitches 31 as shown in FIG. 6. However, the strap end portion 29 may be attached to the connecting bar 16 in the manner described above. Another strap end portion 32 is threaded between the strap connector 17 and the strap retainer 12 from the back to the face of the connector frame 11 and then between the strap retainer 12 and the grip base 13 from the face to the back of the connector frame 11. The strap end portion 32 is frictionally held against the biting ridges 20 while forming a loop 33 around the strap retainer 33.

When the strap end portions 29, 32 thus attached are tensioned longitudinally, the strap retainer 12 is displaced toward the grip base 13 to enable the strap pressing surface 34 to press the strap end portion 32 against the strap bearing surface 18. Then, the corners of the ends of the biting ridges 20 are kept in biting engagement with the strap end portion 32. The strap end portion 32 is now prevented from being loosened off the strap adjustment assembly 10. For adjusting the length of the strap end portion 32, the grip base 13 is gripped by the user, and the connector frame 11 is turned counterclockwise (FIG. 6) through an angle of approximately 90° about the connecting bar 16 until the strap end portion 32 is released from engagement with the strap bearing surface 18 and the biting ridges 20. Then, the strap end portion 32 is longitudinally adjusted until a desired strap length is achieved.

The strap adjustment assembly 10 of the foregoing construction has many advantages: With the ends of the slots 21, 22 closer to the grip base 13 being spaced therefrom by the distance L1, the junctions between the grip base 13 and the legs 14, 15 are mechanically strong and resistant to forces tending to break the junctions notwithstanding the fact that the connector assembly 11 is made of synthetic resin. The movable strap retainer 12, with its strap pressing surface 34 projecting beyond the arms 24, 25 by the distance L1, can press the strap end portion forcibly and reliably against the strap bearing surface 18. A relatively thin strap can therefore be securely retained in place. Both the strap bearing surface 18 and the strap pressing surface 34 are flat to provide a wider area of contact with the strap, producing a large frictional resistance against the strap sandwiched therebetween. The roughened surface of the central strap engagement portion 23 also serves to impose an increased frictional resistance to the strap. The strap is also locked in place by the biting ridges 20 against being released or loosened off the strap adjustment assembly 10 unless the latter is turned counterclockwise (FIG. 6) through an angle of approximately 90° about the connecting bar 16. Loosening of the strap is further prevented by the arms 24, 25 fitting slidably but not rotatably in the respective elongated slots 21, 22. The slanted surface 19 and the arcuate surface 35 allow easy insertion of the strap between the grip base 13 and the strap retainer 12 from the face to the back of the connector frame 11.

The legs 14, 15 are transversely spaced from each other by a distance L2 slightly narrower than a strap used by 0.3 to 0.5 mm, for example. This negative clearance is preferable in that the strap as retained on the strap retainer 12 will not be released or loosened due to frictional resistance between lateral edges of the strap and the legs 14, 15 as when the strap becomes free of tensioning forces or the bag on which the strap adjustment assembly 10 is used is not carried by the user. Accordingly, there is no need for strap adjustment when the bag is carried by the user again. If the distance L2 were larger than the width of a strap used, the strap would easily be loosened off the strap adjustment assembly 10 or the latter would move relatively to the strap when the strap is released of tensioning forces.

FIGS. 8 through 13 illustrate a strap adjustment assembly 39 according to another embodiment of the present invention. The strap adjustment assembly 39 is suitable for use, for example, as a male member of a buckle on each of a pair of suspenders.

The strap adjustment assembly 39 includes an integrally molded construction composed of a male member 40 and a hollow or open rectangular connector frame 41, and a strap retainer 42 movably mounted on the connector frame 41. The male member 40, the hollow connector frame 41, and the strap retainer 42 are all made of synthetic resin. The connector frame 41 comprises a base 43, a pair of legs 44, 45 extending transversely from opposite ends of the base 43, and a connecting bar 36 transversely joining the legs 44, 45 at distal ends thereof remote from the base 43.

Figure 8:
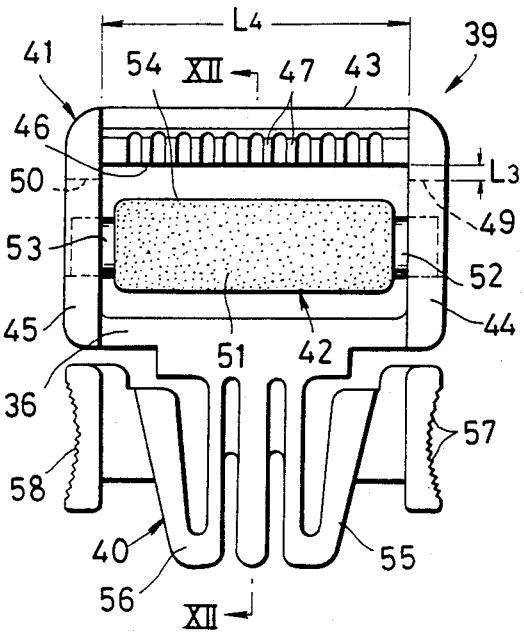
FIG. 8 is a plan view of another embodiment of the present invention.
Figure 9:
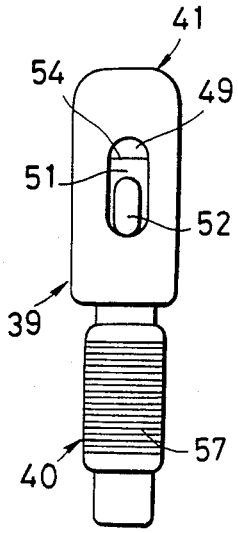
FIG. 9 is a side elevational view of FIG. 8.
Figure 10:
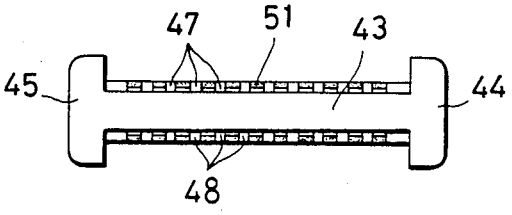
FIG. 10 is a an end elevational view of FIG. 8.
Figure 11:
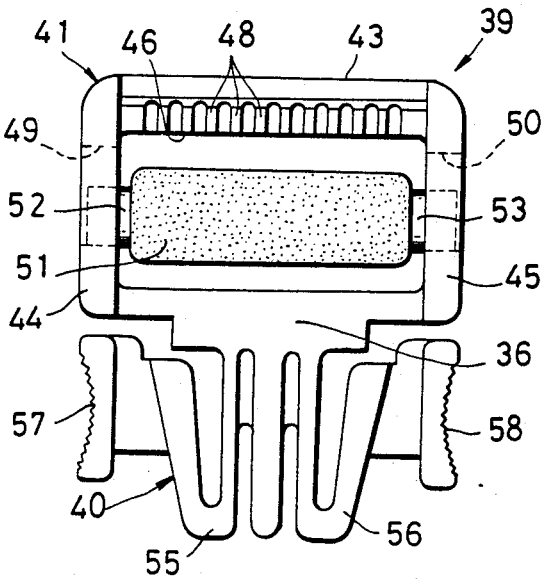
FIG. 11 is a bottom view of FIG. 8.
Figure 12:
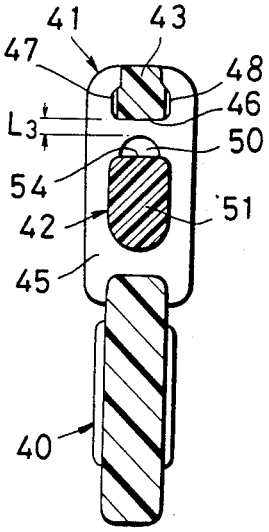
FIG. 12 is a cross-sectional view taken along line XII—XII of FIG. 8.

The base 43 has a flat strap bearing surface 46 facing toward the connector bar 36. The base 43 also has a plurality of biting ridges 47, 48 on its opposite surfaces, the biting ridges 47, 48 extending parallel to the legs 44, 45 from the strap bearing surface 46. The biting ridges 47, 48 have end surfaces lying flush with the strap bearing surface 46. The legs 44, 45 have a pair of oblong slots 49, 50 in transverse registry with each other, the slots 49, 50 having ends spaced a distance L3 from the strap bearing surface 46 as shown in FIGS. 8 and 12, to provide a sufficient mechanical strength at the joints of the base 43 and the legs 44, 45.

The strap retainer 42 is composed of a central strap engagement portion 51 having a roughened surface similar to a grain finish and a pair of coaxial arms 52, 53 integrally formed with the strap engagement portion 51 at opposite ends thereof. The arms 52, 53 have an elliptical cross section, and are loosely received in the oblong slots 49, 50 respectively for sliding movement therein, but are prevented from rotating in the respective slots 49, 50. The central strap engagement portion 51 has a strap pressing surface 54 facing toward and lying parallel to the strap bearing surface 46. The strap pressing surface 54 is laterally spaced from the arms 52, 53 substantially by the distance L3. The arms 52, 53 are slightly displaced toward the connecting bar 36 off center with respect to the central strap engagement portion 51.

The male member 40 has a pair of resiliently flexible legs 55, 56 extending from the connecting bar 36 and a pair of grip feet 57, 58 mounted on the legs 55, 56, respectively. When the male member 40 is inserted in a female member (not shown), the grip feet 57, 58 are pressed against inner surfaces of the female member under the resilient force of the legs 55, 56 to thereby connect the strap adjustment assembly 40 to the female member.

The strap retainer 42 can be molded at the same time that the connector frame 41 is molded so that they are molded in an assembled condition. Such molding operation can be accomplished by using the molds 26 shown in FIG. 7.

Figure 13:
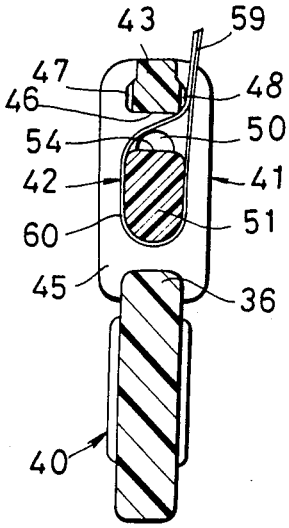
FIG. 13 is a view similar to FIG. 12 showing the manner in which the strap adjustment assembly of FIG. 8 is used.

The strap adjustment assembly 40 thus described is symmetrical and will be used as follows: A strap end portion 59 is threaded between the strap retainer 42 and the connecting bar 36 from either side to the other of the connector frame 41 and then threaded back between the strap retainer 42 and the base 43, thus providing a strap loop 60 around the strap retainer 42, as shown in FIG. 13. The male member 40 is frictionally inserted into the female member. When the strap is tensioned longitudinally, the strap retainer 42 is displaced toward the base 43 until the strap end portion 59 is pressed by the strap pressing surface 54 against the strap bearing surface 46. At this time, the strap end portion 59 is also engaged securely by corners of the biting ridges 48 (or ridges 47 if threaded from the other side) against forces tending to loosen the strap end portion 59 off the connector frame 41. To adjust the length of the strap, the base 43 is gripped by the user and turned counterclockwise (FIG. 13) about the connecting bar 36 through an angle of about 90° until the strap end portion 59 is disengaged from the biting ridges 48. The strap retainer 42 is then displaced from the base 43, and the strap end portion 59 can be pulled in any direction for length adjustment.

The legs 44, 45 are transversely spaced from each other by a distance L4 slightly smaller than the width of the strap used so that the strap will frictionally be engaged edgewise by the legs 44, 45 when the strap is released of any tension. This feature prevents the strap from being loosened accidentally when not in use.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A strap adjustment assembly comprising:

(a) a molded connector frame of synthetic resin including
  (1) a grip base having a flat strap bearing surface;
  (2) a pair of spaced legs extending integrally from opposite ends of said grip base and having a pair of transversely aligned slots, respectively, spaced from said flat strap bearing surface of said grip base by a distance, said slots having an oblong shape, and
  (3) a connecting bar extending integrally between said legs remotely from said grip base; and (b) a strap retainer of molded synthetic resin including
  (1) a central strap engagement portion, and
  (2) a pair of arms extending integrally from opposite ends of said central strap engagement portion and loosely fitted in said slots, respectively, said arms being disposed out of coaxial alignment with said central strap engagement portion and toward said connecting bar, said central strap engagement portion having a flat strap pressing surface extending parallel to said flat strap-bearing surface for frictionally pressing a strap end portion against said flat strap-bearing surface, said flat strap pressing surface being transversely spaced from said arms, at least by said distance, each of said arms having an elliptical cross section and being prevented from rotating in the respective oblong slots, said grip base, said legs, said connecting bar and said strap retainer being disposed in a plane lying substantially in the middle of the thickness of said strap adjusting assembly, said connector frame and said strap retainer having been molded in an assembled condition with said arms in said slots.

2. A strap adjustment assembly comprising:

(a) a molded connector frame of synthetic resin including
  (1) a grip base having a flat strap bearing surface;
  (2) a pair of spaced legs extending integrally from opposite ends of said grip base and having a pair of transversely aligned slots, respectively, spaced from said flat strap bearing surface of said grip base by a distance, said slots having an oblong shape, and
  (3) a connecting bar extending integrally between said legs remotely from said grip base; and (b) a strap retainer of molded synthetic resin including
  (1) a central strap engagement portion, and (2) a pair of arms extending integrally from opposite ends of said central strap engagement portion and loosely fitted in said slots, respectively, said central strap engagement portion having a flat strap pressing surface extending parallel to said flat strap-bearing surface for frictionally pressing a strap end portion against said flat strap-bearing surface, said flat strap pressing surface being transversely spaced from said arms, at least by said distance, each of said arms having an elliptical cross section and being prevented from rotating in the respective oblong slots, said grip base, said legs, said connecting bar and said strap retainer being disposed in a plane lying substantially in the middle of the thickness of said strap adjusting assembly, said connector frame and said strap retainer having been molded in an assembled condition with said arms in said slots.

3. A strap adjustment assembly comprising:

(a) a molded connector frame of synthetic resin including (1) a grip base having a flat strap bearing surface;

(2) a pair of spaced legs extending integrally from opposite ends of said grip base and having a pair of transversely aligned slots, respectively, spaced from said flat strap bearing surface of said grip base by a distance, said slots having an oblong shape, and (3) a connecting bar extending integrally between said legs remotely from said grip base; and (b) a strap retainer of molded synthetic resin including (1) a central strap engagement portion, and (2) a pair of arms extending integrally from opposite ends of said central strap engagement portion and loosely fitted in said slots, respectively, said arms being disposed out of coaxial alignment with said central strap engagement portion and toward said connecting bar, said central strap engagement portion having a flat strap pressing surface extending parallel to said flat strap-bearing surface for frictionally pressing a strap end portion against said flat strap-bearing surface, said flat strap pressing surface being transversely spaced from said arms, at least by said distance, each of said arms having an elliptical cross section and being prevented from rotating in the respective oblong slots, said grip base, said legs, said connecting bar and said strap retainer being disposed in a plane lying substantially in the middle of the thickness of said strap adjusting assembly.

* * * * *